US008402910B2

(12) United States Patent
Pei

(10) Patent No.: US 8,402,910 B2
(45) Date of Patent: Mar. 26, 2013

(54) DIP COATING APPARATUS

(75) Inventor: Shao-Kai Pei, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 485 days.

(21) Appl. No.: 12/758,037

(22) Filed: Apr. 12, 2010

(65) Prior Publication Data

US 2011/0088615 A1 Apr. 21, 2011

(30) Foreign Application Priority Data

Oct. 21, 2009 (CN) ..... 2009 1 0308565

(51) Int. Cl.
*B05C 3/10* (2006.01)
*B05C 13/00* (2006.01)

(52) U.S. Cl. ..... 118/66; 118/58; 118/416; 118/426; 118/428; 118/429; 118/500

(58) Field of Classification Search ..... 118/416, 118/426, 500, 58, 66; 427/430.1, 437; 134/105, 134/143, 76, 140; 34/209, 210, 211
See application file for complete search history.

(56) References Cited

U.S. PATENT DOCUMENTS 2,515,489 A * 7/1950 Borushko ..... 427/377
4,191,365 A * 3/1980 O'Neill ..... 269/46
2003/0140859 A1 * 7/2003 Ukiyo et al. ..... 118/726

FOREIGN PATENT DOCUMENTS

JP 2-160070 A 6/1990

* cited by examiner

*Primary Examiner* — Laura Edwards
(74) *Attorney, Agent, or Firm* — Altis Law Group, Inc.

(57) ABSTRACT

A dip coating apparatus includes a housing and a workpiece holder movably and rotatably received in the housing. The housing includes an immersing portion configured for carrying out immersion process and a drying portion configured for carrying out drying process. The inner spaces of the immersing portion and the drying portion are communicated with each other. The lifting workpiece holder is configured for fixed workpieces thereon and moving and rotating relative to the immersing portion and the drying portion of the housing. The workpieces are driven by the lifting-rotating to carry out the immersion process and the drying process.

16 Claims, 2 Drawing Sheets

DIP COATING APPARATUS

BACKGROUND

1. Technical Field

The present disclosure relates to a dip coating apparatus.

2. Description of Related Art

In dip a coating process, workpieces, such as substrates, that need to be coated are immersed into solution of coating material for depositing the coating material on the surface of the workpieces, the workpieces are taken out of the solution and are dried. However, the immersion process and the drying process are respectively carried out in different devices, after the immersion process, the workpieces should be taken out of the immersion device and carried into a drying device via a special carrying tray. Therefore, the workpieces may get contaminated during relocation, such that the quality of the coated workpieces can not be ensured.

What is needed, therefore, is a dip coating apparatus to overcome the above-mentioned problems.

BRIEF DESCRIPTION OF THE DRAWINGS

The components of the drawings are not necessarily drawn to scale, the emphasis instead being placed upon clearly illustrating the principles of the embodiments of the dip coating apparatus. Moreover, in the drawings, like reference numerals designate corresponding parts throughout the views.

DETAILED DESCRIPTION

Figure 1:
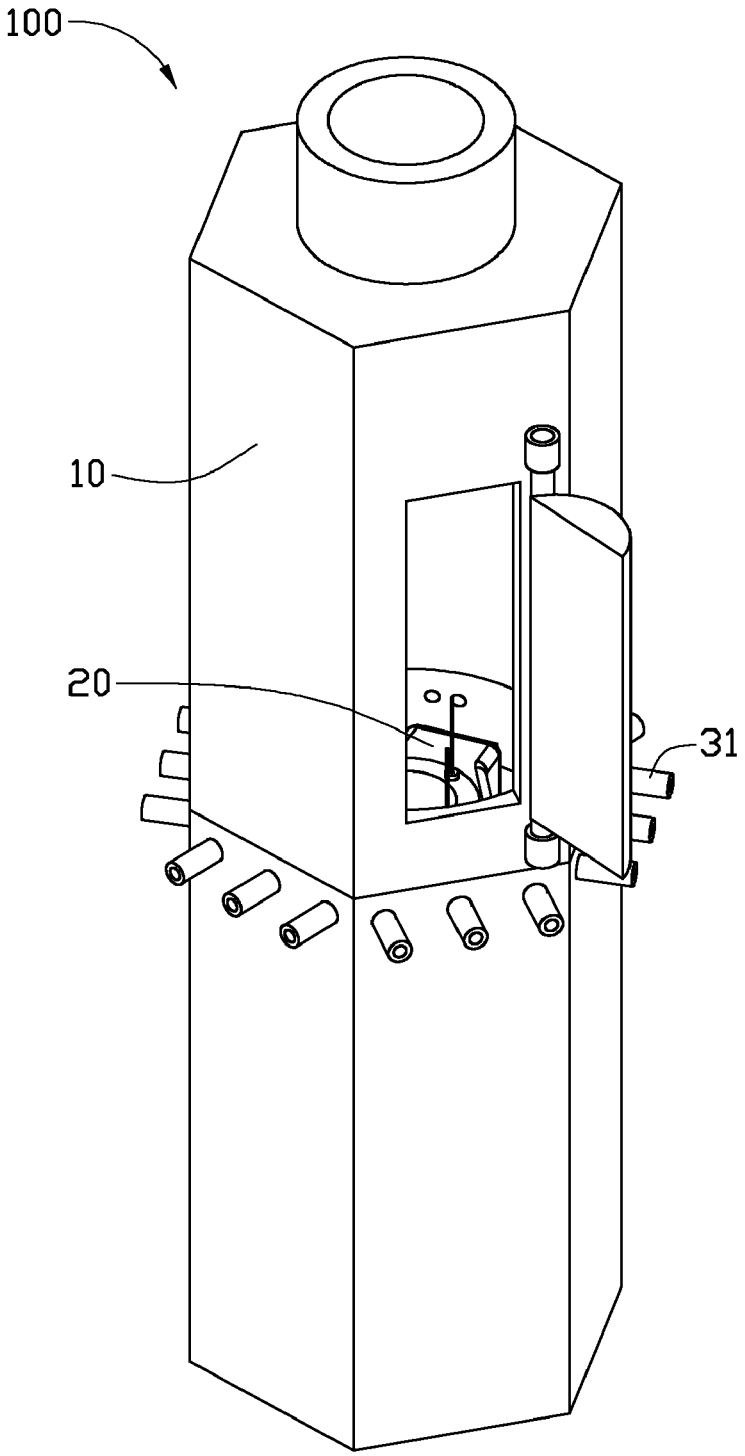
FIG. 1 is an isometric view of a dip coating apparatus, according to an exemplary embodiment of the present disclosure.

Referring to FIG. 1, a dip coating apparatus 100, according to an exemplary embodiment, is shown. The dip coating apparatus 100 includes a housing 10 and a workpiece holder 20. The workpiece holder 20 is received in the housing 10 and can move up and down and rotate in the housing 10.

Figure 2:
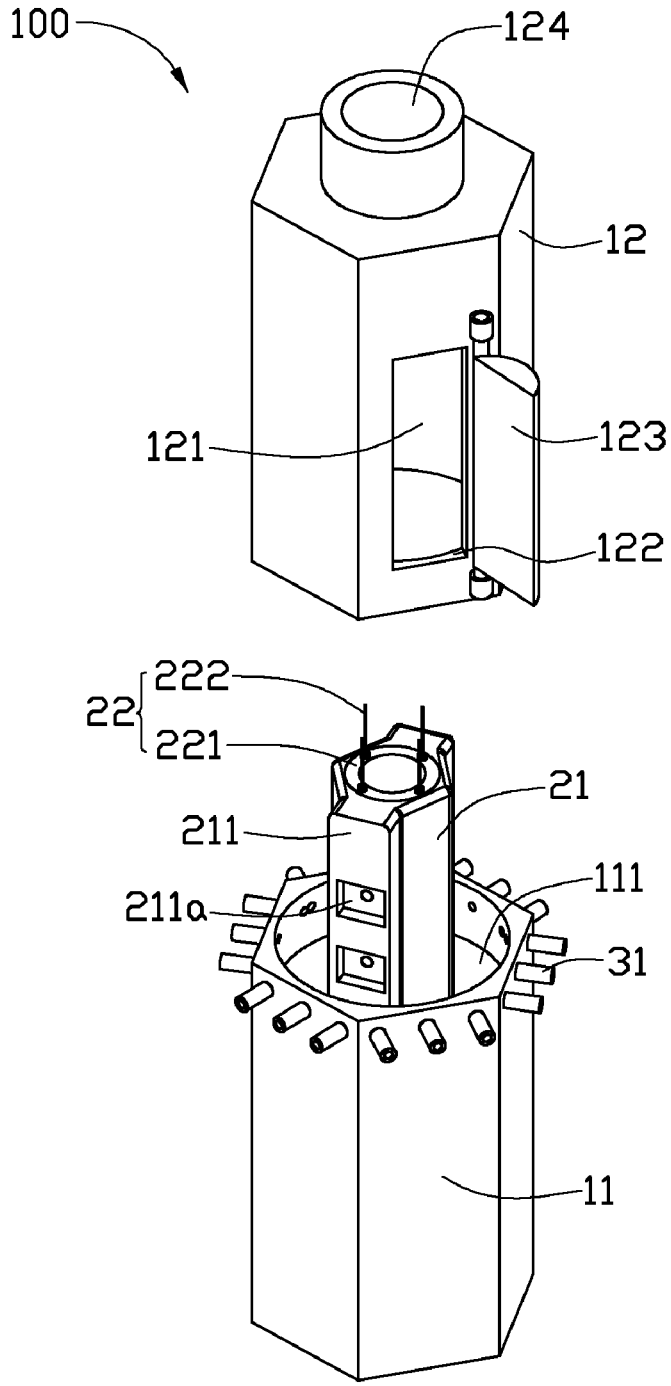
FIG. 2 is an exploded view of the dip coating apparatus of FIG. 1.

Referring to FIG. 2, the housing 10 includes an immersing portion 11 and a drying portion 12 connected to the immersing portion 11. The immersing portion 11 defines an immersion chamber 111 configured to contain solution of the coating material. The drying portion 12 defines a drying chamber 121 and an opening 122 in a side wall. The drying chamber 121 is configured for drying workpieces after the immersion process. The immersion chamber 111 and the drying chamber 121 communicate with each other. The opening 122 communicates with the drying chamber 121. The drying portion 12 includes a hatch 123 rotatably connected to a side of the opening 122 for enclosing the opening 122. The drying portion 12 further defines an exhaust hole 124. The exhaust hole 124 communicates with the drying chamber 121 and is configured for exhausting heated air during drying process.

The workpiece holder 20 is substantially column-shaped. The workpiece holder 20 includes a rotating member 21 and a heating member 22 passing through the rotating member 21. The rotating member 21 includes two fixing portions 211 integrally connected with the rotating member 21 and arranged on opposite sides of the rotating member 21. Each fixing portion 211 defines a plurality of fixing troughs 211*a* for fixing workpieces therein. The shape of the troughs 211*a* can be changed according to different shapes of workpieces. The heating member 22 is configured for heating workpieces and the solution of coating material in predetermined range of temperature. The heating member 22 includes a heating core 221 and a plurality of heating rods 222 passing through the heating core 221. The heating core 221 is made of thermal conductive material, such as aluminum, or copper, to conduct heat to workpieces. In this embodiment, the heating rods 222 are electrothermal.

The housing 10 further includes a number of blow tubes 31. Each blow tube 31 is connected to the immersing portion 11 and communicates with the immersion chamber 111. Alternatively, the blow tubes 11 can also connect to the drying portion 12 and communicate with the drying chamber 121. The blow tubes 31 are configured to connect to a blower (not shown) and allow air blown by the blower to enter into the housing 10.

In use, first, the workpiece holder 20 rises up to the drying chamber, then the workpiece holder 20 rotates to let one of the fixing portions 211 face the opening 122, then, a number of workpieces (not shown) are correspondingly fixed into the fixing troughs 211*a* which now faces the opening 122. After the workpieces are fixed, the workpiece holder can rotate again to let the other fixing portions 211 face the opening 122, and then a number of workpieces can be fixed to the fixing troughs 211*a* which now face the opening 122. After each of the fixing troughs 211*a* receives a corresponding workpiece or all the workpieces are fixed to the fixing troughs 211*a*, the hatch 123 is closed.

Secondly, solution (not shown) of coating material is infused into the immersion chamber 111, then the workpiece holder 20 is descended into the immersion chamber 111, the workpieces are immersed into the solution, and then immersion process is stared. During the immersion process, the workpiece holder 20 slowly rotates and/or moves up and down for getting a desired deposit effect, and the heating rods 222 can be turned on to heat the solution to a desired temperature. After the immersion process, the workpiece holder rises up to the drying chamber 121, and then drying process starts. During the drying processing, the workpiece holder 20 is rotated at a predetermined speed to enhance the evaporation speed of the liquid on the surface of the workpieces. At the same time, air can be blown through the blow tubes 31 into the drying chamber 121 to enhance the evaporation speed of liquid on the surface of the workpieces. In addition, the temperature of the heat rods 222 can be controlled to a predetermined range, so that a desired change can be made in the crystal phase of the coating material deposited on the surface of the workpieces.

Both the immersion processes and the drying processes are completed in the one dip coating device 100. Therefore, there is no need to carry workpiece from one device to another between the immersion process and the drying process. As a result, the cost of the dip coating process of the workpieces is reduced, and the contamination of workpieces can be avoided, ensuring the quality of the coated workpieces.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A dip coating apparatus for coating workpieces, comprising:

a housing comprising an immersing portion configured for carrying out immersion process and a drying portion configured for carrying out drying process; and a workpiece holder movably and rotatably received in the housing;

wherein the inner spaces of the immersing portion and the drying portion communicate with each other, the workpiece holder is configured for fixing the workpieces thereon and moving and rotating relative to the immersing portion and the drying portion of the housing, the workpieces are driven by the workpiece holder to carry out the immersion process and the drying process, the workpiece holder comprises a rotating member and a heating member passing through the rotating member, and the heating member is configured for heating the workpieces in a predetermined range of temperature.

2. The dip coating apparatus of claim 1, wherein the immersing portion defines an immersion chamber configured for containing solution of coating material and carrying out immersion process, the drying portion defines a drying chamber configured for drying workpieces after the immersion process, and the immersion chamber and the drying chamber communicate with each other.

3. The dip coating apparatus of claim 1, wherein the drying portion defines an opening in a side wall thereof, and comprises a hatch rotatably connected to a side of the opening and configured for enclosing the opening.

4. The dip coating apparatus of claim 1, wherein the drying portion defines an exhaust hole configured for exhausting heated air during the drying process.

5. The dip coating apparatus of claim 1, wherein the rotating member comprises two fixing portions integrally connected with the rotating member and arranged on opposite sides of the rotating member.

6. The dip coating apparatus of claim 5, wherein each of the fixing portions defines a plurality of fixing troughs for fixing the workpieces therein.

7. The dip coating apparatus of claim 1, wherein the heating member comprises a heating core and a plurality of heating rods passing through the heating core, the heating core is made of thermal conductive materials for conducting heat from the heat rods to workpieces, and the heating rods are electrothermal.

8. The dip coating apparatus of claim 1, wherein the housing comprises a plurality of blow tubes configured for blowing air into the housing.

9. A dip coating apparatus for coating workpieces, the dip coating apparatus comprising:

a housing comprising an immersing portion configured for carrying out immersion process and a drying portion configured for carrying out drying process, the drying portion comprising an opening defined in the side wall thereof and configured for allowing the workpieces to pass through, a hatch connected to a side of the opening and configured for enclosing the opening, and an exhaust hole configured for exhausting heated air during the drying process; and a workpiece holder movably and rotatably received in the housing, and comprising a plurality of fixing portions arranged thereon;

wherein the inner spaces of the immersing portion and the drying portion are communicated with each other, the workpieces are fixed on the fixing portion passing through the opening, the workpiece holder is configured for moving and rotating relative to the immersing portion and the drying portion of the housing, and the workpieces are driven by the workpiece holder to carry out the immersion process and the drying process, the workpiece holder comprises a rotating member and a heating member passing through the rotating member, and the heating member is configured for heating the workpieces in a predetermined range of temperature.

10. The dip coating apparatus of claim 9, wherein the immersing portion defines an immersion chamber configured for containing solution of coating material and carrying out immersion process therein, and the drying portion defines a drying chamber configured for drying workpieces after the immersion process, and the immersion chamber and the drying chamber are communicated with each other.

11. The dip coating apparatus of claim 9, wherein the plurality of fixing portions comprises two fixing portions integrally connected with the rotating member and arranged on opposite sides of the rotating member.

12. The dip coating apparatus of claim 9, wherein the heating member comprises a heating core and a plurality of heating rods passing through the heating core, the heating core is made of thermal conductive materials for conducting heat from the heat rods to the workpieces, and the heating rods are electrothermal.

13. The dip coating apparatus of claim 9, wherein each of the fixing portions defines a plurality of fixing troughs configured for fixing the workpieces therein.

14. The dip coating apparatus of claim 9, wherein the housing includes a plurality of blow tubes configured for blowing air into the housing.

15. A dip coating apparatus for coating workpieces, comprising:

a housing comprising:

an immersing portion defining an immersion chamber configured to contain solution of coating material; and a drying portion defining an drying chamber communicating with the immersion chamber; and a workpiece holder configured to hold the workpieces, the workpiece holder being received in the housing and capable of moving the workpieces from the immersion chamber to the drying chamber and rotating the workpieces in the housing, the workpiece holder comprising a rotating member and a heating member passing through the rotating member, and the heating member configured for heating the workpieces in a predetermined range of temperature.

16. The dip coating apparatus of claim 15, wherein the drying portion defines an opening in a side wall thereof, and comprises a hatch rotatably connected to a side of the opening and configured for enclosing the opening; the rotating member comprises a plurality of fixing portions configured to hold the workpieces; the rotating member is capable of rotating and being moved to make the fixing portions face the opening.

* * * * *